United States Patent [19]

Kunz

[11] 4,358,350

[45] Nov. 9, 1982

[54] STRONGLY ACID GOLD ALLOY BATH

[75] Inventor: Peter Kunz, Schwabisch Gmund, Fed. Rep. of Germany

[73] Assignee: Degussa AG, Frankfurt, Fed. Rep. of Germany

[21] Appl. No.: 270,211

[22] Filed: Jun. 3, 1981

[30] Foreign Application Priority Data

Jun. 10, 1980 [DE] Fed. Rep. of Germany ..... 3021665

[51] Int. Cl.[3] ..... C25D 3/62

[52] U.S. Cl. ..... 204/43 G

[58] Field of Search ..... 204/43 G, 46 G, 123

[56] References Cited

U.S. PATENT DOCUMENTS

| | | | |
|---|---|---|---|
| 3,893,896 | 7/1975 | Korbelak et al. | 204/44 |
| 3,923,612 | 12/1975 | Wiesner | 204/43 G |
| 4,168,214 | 9/1979 | Fletcher et al. | 204/43 G |
| 4,192,723 | 3/1980 | Laude et al. | 204/43 G |

FOREIGN PATENT DOCUMENTS

| | | | |
|---|---|---|---|
| 1521043 | 7/1969 | Fed. Rep. of Germany | 204/43 G |
| 51-50234 | 1/1976 | Japan | 204/43 G |
| 56-44790 | 4/1981 | Japan | 204/43 G |
| 1051383 | 12/1966 | United Kingdom | 204/43 G |
| 322411 | 9/1971 | U.S.S.R. | 204/43 G |

*Primary Examiner*—G. L. Kaplan

*Attorney, Agent, or Firm*—Cushman, Darby & Cushman

[57] ABSTRACT

For the production of abrasion resistant gold alloy coatings of low electrical contact resistance which remains constant there are needed electrolytic baths from which platinum metals can be codeposited. There are suited for this strongly acid electrolytic baths containing 1–10 g/l of gold in the form a tetracyanoaurate (III) and 0.1–5 g/l of platinum metal in the form of a soluble salt which is operated at a pH of less than 2.

7 Claims, No Drawings

STRONGLY ACID GOLD ALLOY BATH

BACKGROUND OF THE INVENTION

The invention is directed to a strongly acid bath for the electrolytic deposition of gold alloy coatings having a low content of platinum metals.

For the gold plating of low current contacts preferably there are employed in the electro arts electrolytic gold baths whose gloss and wear resistance are produced by the addition of small amounts of soluble salts of the iron metals, iron, cobalt and nickel. Such gold baths are operated mostly in a citrate buffer (pH 3–6) having a gold content between 1 and 12 g/l as potassium dicyanoaurate (I) as well as soluble salts of iron, cobalt and nickel in concentration of 50 mg to 5 g/l. These coatings deposit up to 10 microns thick in glossy and crack free form and are wear resistant. Disadvantageous is the fact that with the coatings produced from such baths the contact resistance of the coating, caused by the non-noble components in the precipitating alloys, increases under unfavorable conditions around several powers of ten compared to pure gold.

This increase of the contact resistance is not observed on electrolytic coatings of palladium, rhodium and platinum. Since such coatings at present cannot be produced crack free in thicknesses as desired or because the price of these metals are uneconomical the use of the platinum metals as contact material has not been able to be carried through. Since it is known from metallurgically produced gold alloys with platinum metals as alloying elements that they exhibit a constant low resistance it has already been tried to deposit gold and platinum metals together from aqueous solution. Thus there is known from U.S. Pat. No. 3,923,612 an electrolytic bath in which gold aurate solutions are heated at pH values of around 14 with small amounts of platinum in the form of the hexahydroplatinate. There are obtained from such solutions gold/platinum alloy coatings which do not exhibit the above described disadvantages. The disadvantage of these baths is the expensive production of the gold aurate solution as well as the slight stability against fluctuations in pH in operation.

There are likewise known attempts to codeposit platinum group metals from acidic gold alloy baths in which the gold is present in weakly acid solution (pH 4–6) as dicyanoaurate (I) (Korbelak U.S. Pat. No. 3,893,896 the entire disclosure of which is hereby incorporated by reference and relied upon), but in these baths only the very slightest amounts of platinum metals can be deposited together with the gold. The necessary hardness and therewith the necessary wear resistance for contact gold coatings accordingly are not attained.

Therefore it was the problem of the present invention to develop a strongly acid bath for the electrolytic deposition of gold alloy coatings having low contents of platinum group metals which produce hard, abrasion resistant coatings having a low, electrical contact resistance which remains constant, is easy to produce and remains stable in operation.

SUMMARY OF THE INVENTION

This problem was solved according to the invention by the bath containing 1–10 g/l of gold in the form of tetracyanoaurate (III) and 0.1–5 g/l of platinum group metal in the form of a soluble salt and operating a a pH of less than 2. As tetracyanoaurate (III) there can be used for example the alkali metal tetracyanoaurates (III), e.g. potassium tetracyanoaurate (III) and sodium tetracyanoaurate (III). Preferably the baths additionally contain 10–200 g/l of phosphoric acid and 5–100 g/l of sodium sulfate. As platinum group metal additives there are preferred palladium, platinum and rhodium or mixtures thereof. Preferably the baths have a pH of less than 1.

Suitable soluble platinum gold metal salts include for example palladium sulfite complex, potassium hexachloraplatinate (IV), sodium hexachloro platinate (IV), hexachloroplatinic acid (IV), palladium dichloride, sodium hexachlororhodate (II), palladium sulfate, platinum sulfate, rhodium (III) chloride and rhodium (III) sulfate.

The baths of the invention surprisingly show an outstanding stability in operation, give hard (HV 160–200), abrasion resistant coatings having a constant remaining low resistance to conduction of electric current which in spite of relatively high addition of platinum metal in the bath only have small portions of platinum metal in the gold alloy coatings.

Unless otherwise indicated all parts and percentages are by weight.

The compositions can comprise, consist essentially of or consist of the stated material.

The following examples illustrate the baths of the invention in greater detail.

DETAILED DESCRIPTION

EXAMPLE 1

An electrolyte of an aqueous solution of 20 grams of sodium sulfate per liter was adjusted to a pH below 1 with chemically pure phosphoric acid. To this electrolyte there was added gold in the form of potassium tetracyanoaurate (III) in a concentration of 5 g/l based on gold as the metal. When this solution was electrolyzed with insoluble anodes, perchance with anodes of platinized titanium, there were obtained on a nickeled brass cathode glossy coatings of fine gold having a Vickers hardness of about 90. When there was added to this electrolyte 0.5 g/l of palladium in the form of its sulfite complex there were obtained hard gold alloy coatings which contained palladium.

EXAMPLE 2

To the above mentioned base electrolyte containing 5 g/l of Au tetracyanoaurate (III) there was added rhodium in a concentration of 200 mg/l in the form of its phosphate complex. In the electrolysis of this solution there were obtained yellow gold coatings having a hardness of HV 160.

EXAMPLE 3

Gold-platinum coatings were obtained by adding to the base electrolyte used in Examples 1 and 2 2 g/l of platinum in the form of its hexachloroplatinate (IV). From such a solution there were obtained pale yellow gold-platinum alloy coatings having a hardness of over HV 200.

The entire disclosure of German priority application No. P 3021665.0 is hereby incorporated by reference.

What is claimed is:

1. A strongly acid bath suitable for the electrolytic deposition of a gold alloy coating having a low content of a platinum group metal comprising an aqueous solution containing 1–10 g/l of gold in the form of tetracyanoaurate (III), 0.1–5 g/l of a platinum group metal in the form of a water soluble salt, 10–200 g/l of phosphoric acid and 5–100 g/l of sodium sulfate and having a pH below 2.

2. A bath according to claim 1 wherein the platinum group metal is palladium, platinum, rhodium or a mixture of at least two of these metals.

3. A bath according to claim 2 wherein the platinum group metal is platinum.

4. A bath according to claim 2 wherein the platinum group metal is palladium.

5. A bath according to claim 2 wherein the platinum group metal is rhodium.

6. A bath according to claim 2 having a pH less than 1.

7. A bath according to claim 1 having a pH less than 1.

* * * * *